US011760447B2

(12) United States Patent
Kristensen

(10) Patent No.: US 11,760,447 B2
(45) Date of Patent: Sep. 19, 2023

(54) SYSTEM FOR STABILIZING A VESSEL AGAINST A STATIONARY OBJECT

(71) Applicant: Offshore Windservice A/S, Thyborøn (DK)

(72) Inventor: Billy Thøger Kristensen, Thyborøn havn (DK)

(73) Assignee: OFFSHORE WINDSERVICE A/S, Thyborøn (DK)

( * ) Notice: Subject to any disclaimer, the term of this patent is extended or adjusted under 35 U.S.C. 154(b) by 24 days.

(21) Appl. No.: 17/330,533

(22) Filed: May 26, 2021

(65) Prior Publication Data

US 2021/0371061 A1 Dec. 2, 2021

(30) Foreign Application Priority Data

May 27, 2020 (EP) ..... 20176699

(51) Int. Cl.

| | |
|---|---|
| ***B63B 59/02*** | (2006.01) |
| ***B63B 21/00*** | (2006.01) |
| ***B63B 27/30*** | (2006.01) |
| *B63B 39/00* | (2006.01) |

(52) U.S. Cl.

CPC ..... *B63B 59/02* (2013.01); *B63B 21/00* (2013.01); *B63B 27/30* (2013.01); *B63B 39/005* (2013.01)

(58) Field of Classification Search

CPC ..... B63B 21/00; B63B 27/00; B63B 27/30; B63B 39/00; B63B 39/005; B63B 59/00; B63B 59/02

USPC ..... 114/219

See application file for complete search history.

(56) References Cited

FOREIGN PATENT DOCUMENTS

| | | | | |
|---|---|---|---|---|
| EP | 2316721 A1 | | 5/2011 | |
| EP | 2520485 A1 | | 11/2012 | |
| EP | 2316721 B1 | | 3/2013 | |
| EP | 2829468 A2 | | 1/2015 | |
| GB | 2476858 A | | 7/2011 | |
| GB | 2485868 A | | 5/2012 | |
| WO | WO-2005097590 A1 | * | 10/2005 | ..... B63B 21/00 |
| WO | 2018033623 A1 | | 2/2018 | |

OTHER PUBLICATIONS

European Patent Office, Extended European Search Report, Application No. 20176699.5, Applicant: Offshore Windservice AS, dated Jan. 21, 2021.

* cited by examiner

*Primary Examiner* — Lars A Olson
(74) *Attorney, Agent, or Firm* — FLENER IP & BUSINESS LAW; Zareefa B. Flener

(57) ABSTRACT

Vessel (60), comprising a transverse bow (62) with an elongated bow fender (10) protruding with respect to the bow (62), which bow fender (10) is designed to be pushed against a stationary object (50), said vessel 60) further comprises at least two engagement arms (20) with telescopic parts (22,24), said engagements arms (20) are mounted in a position above the bow fender (10) and facing each other, and each engagement arm (20) is pivotable against each other for engagement with the stationary object (50) from opposite directions. Each engagement arm (20) comprises a tiltable engagement pad (26) with a contacting surface (26*a*) creating stabilizing contact between the contacting surfaces (26*a*) of the engagement pads (26) and at least a part of the stationary object (50), said engagement pads (26) being tiltable about an axis running in same longitudinal direction as the engagement arms (20).

16 Claims, 4 Drawing Sheets

SYSTEM FOR STABILIZING A VESSEL AGAINST A STATIONARY OBJECT

CROSS-REFERENCE TO RELATED APPLICATIONS

This application claims the benefit of priority to European Patent Application No. 20176699.5 filed on May 27, 2020 and incorporated in its entirety by reference herein.

FIELD OF THE INVENTION

The present invention relates to a vessel comprising a transverse bow with an elongated bow fender protruding with respect to the bow, which bow fender is designed to be pushed against a stationary object. The vessel further comprises at least two engagement arms with telescopic parts, said engagements arms are mounted in a position above the bow fender and facing each other, and each engagement arm is pivotable against each other for engagement with the stationary object from opposite directions.

The vessel can for instance be a service vessel for the offshore wind industry and oil and gas market.

BACKGROUND OF THE INVENTION

Offshore wind turbines are normally gathered in wind farms placed on the continental shelf with reduced water dept. Higher wind speeds are available offshore compared to land, which supplies more energy.

Oil and gas platforms, special in Far East, Mexico, Brazil etc. where service personnel need to embark and disembark the platforms from service vessels, the inventive bow fender with sideways forces, will improve the vessels stability, and safety and ability for the service personnel.

Offshore wind power refers to the construction of wind farms in bodies of water to generate electricity from wind. Offshore wind power utilizes traditional fixed-bottom wind turbine technologies, as well as deep-water areas utilizing floating wind turbines.

The service crews are normally brought from ports or accommodation vessels with service vessels, and the service personnel embark and disembark between the service vessel and the turbines or platforms.

Each wind turbine has normally two vertical support poles/fender bars to protect the turbine while the service vessel approaches the turbine and allows the service personnel to use the turbine ladder between the two support poles for embarking and disembarking. With the vessel's engines/propellers the vessel's transverse bow-fender is pushed against the support poles.

The challenge is to keep the bow of the vessel steady when the service personnel embark and disembark in rougher sea conditions.

Different solutions have been used. For instance, stabilized walkways have been tried, cranes with claws, etc. One solution is use of a hydraulic clamping system that is mounted on the deck of the crew transfer vessel. Its main elements are two hydraulic arms, which can rotate around a vertical axis. At their front-end a hydraulic clamp is mounted which can be swung around the vertical fender bars of the wind turbine, and by activating two hydraulic rams they pull the vessel's fender against the fender bars with a preset force. The resulting friction stabilizes the position of the vessel.

GB 2476858 A discloses an apparatus for stabilizing a floating craft against a stationary structure. The apparatus comprises means of attaching the apparatus to a floating craft, an elongate fender comprising a structure contacting face, and at least two jaws, each comprising a front face and a structure-contacting surface. At least one jaw is movable from a first position to a second position and vice versa, in order that said jaws may be positioned in a first open position where the structure contacting surfaces of the jaws are relatively far apart and a second closed position wherein the structure contacting surfaces of the jaws are relatively close together. During use, the apparatus is positioned such that a suitably sized part of the stationary structure is placed between the jaws, the said jaws can then be brought into the closed position, thereby creating craft stabilizing contact between the structure contacting surfaces of the jaws and the structure.

EP 2520485 A1 discloses a system for mooring a vessel against a stationary object, for example the mast of a wind turbine erected in water. The stationary object comprises at least one substantially vertical bumper bar, which is attached to the stationary object by means of an extension. The vessel comprises a hull, an engine for propelling the vessel, and a buffer body, which protrudes in relation to the hull. The bumper bar comprises a substantially vertical, inside guide track, which substantially faces the stationary object, and a substantially vertical, outside guide track, which substantially faces away from the stationary object. The vessel comprises at least one engagement arm, which at one end is provided with an engagement member. The engagement arm can be moved in relation to the hull between a mooring state, in which the engagement member engages on the inside guide track of the bumper bar and is vertically displaceable along this, and a release state, in which the engagement member is out of engagement with the inside guide track. The buffer body in the mooring state engages on the outside guide track of the bumper bar and is vertically displaceable along this. The inside guide track protrudes sideways in relation to an adjacent part of the extension of the bumper bar such that the engagement member of the engagement arm in the mooring state can be moved past the extension on vertical displacement along the inside guide track of the bumper bar.

EP2316721 A1 disclose a floating vessel that is stabilized against a stationary object, for example a mast of an offshore wind turbine. The vessel comprises a hull, a motor for the propulsion of the vessel, a buffer body, which protrudes with respect to the hull, as well as at least one engagement arm. The engagement arm is at one end provided with an engagement member for engaging on the stationary object. First, the buffer body of the vessel is pushed against the stationary object by means of the motor. The buffer body is hereby substantially stabilized against the stationary object. Next, the engagement body engages on the stationary object while the buffer body and the stationary object remain mutually stabilized by the pushing. After this, the engagement arm is subjected to tensile load while the stationary object is engaged by the engagement member.

OBJECTS OF THE PRESENT INVENTION

An object of the present invention is to provide an improved, alternative and simplified solution, wherein the vessel's bow fender and engagement equipment is adjustable to improve docking and to stabilize the bow while the service crew embark and disembark in rough sea conditions.

The bow fender of the invention will also improve adjustment of forces acting on the bow fender/bow of the vessel and the wind turbine foundation.

The present invention also provides a solution that makes it easy to center the bow of the vessel to the correct position, which save time and increase the safety.

Is an object to provide as solution that provides even pressure against a wind turbine foundation, when the vessel is rolling transverse to the wind turbine foundation, which improves safety.

It is also an object to provide solution in where the pressure against the wind turbine foundation is adjustable, in both transverse and longitudinally direction.

SUMMARY OF THE INVENTION

The present invention discloses a stabilizing apparatus for a vessel, comprising at least two engagement arms with several telescopic parts, said engagements arms are facing each other, and each engagement arm is pivotable against each other for engagement with a stationary object from opposite directions, each engagement arm comprises a tiltable engagement pad with a contacting surface creating stabilizing contact between the contacting surfaces of the engagement pads and at least a part of the stationary object, said engagement pads being tiltable about an axis running in same longitudinal direction as the engagement arms, wherein the telescopic parts of each engagement arm comprise a first telescopic part and a second housing part, and the engagement pad is tiltable supported in a hinged connection on an outer free end of the first telescopic part.

The present invention further discloses a vessel comprising a transverse bow with an elongated bow fender protruding in a forward direction with respect to the bow, which bow fender is designed to be pushed against a stationary object, said vessel further comprises at least two engagement arms with several telescopic parts, said engagements arms are mounted in a position above the bow fender and facing each other, and each engagement arm is pivotable against each other for engagement with the stationary object from opposite directions, each engagement arm comprises a tiltable engagement pad with a contacting surface creating stabilizing contact between the contacting surfaces of the engagement pads and at least a part of the stationary object, said engagement pads being tiltable about an axis running in same longitudinal direction as the engagement arms, wherein the telescopic parts of each engagement arm comprise a first telescopic part and a second housing part, and the engagement pad is tiltable supported in a hinged connection on an outer free end of the first telescopic part.

The telescopic parts of each engagement arm can comprise a first telescopic part and a second housing part.

The first telescopic part can be extractable and slidably accommodated in the second housing part, and said second housing part can be pivotably supported in a pivot connection.

A first pressure cylinder can be connected between the first telescopic part and the second housing part, providing extraction and retraction of the first telescopic part with respect to the second housing part.

A second pressure cylinder can be connected to the second housing part in an area distal to the pivot connection, providing said pivot movement of the second housing part.

The second housing part may comprise one or more slide guides guiding the pivot movement.

Further, the hinged connection can comprise one or more rubber blocks preventing unwanted tilting movement of the engagement pad with respect to the first telescopic part.

The bow fender preferably comprises an elongated fender made of rubber or polyurethane.

The bow fender can on a front face comprise one or more impressions accommodating at least a part of the stationary object, such as the support poles, and wherein the stabilizing contact between the contacting surfaces of the engagement pads when the engagement arms are activated prevent any substantial movement of said part of the stationary object with respect to the bow fender.

The contacting surface of the tiltable engagement pad can be made of rubber or polyurethane.

DESCRIPTION OF THE FIGURES

Embodiments of the present invention will now be described, by way of example only, with reference to the following figures, wherein.

DESCRIPTION OF PREFERRED EMBODIMENTS OF THE INVENTION

Figure 1:
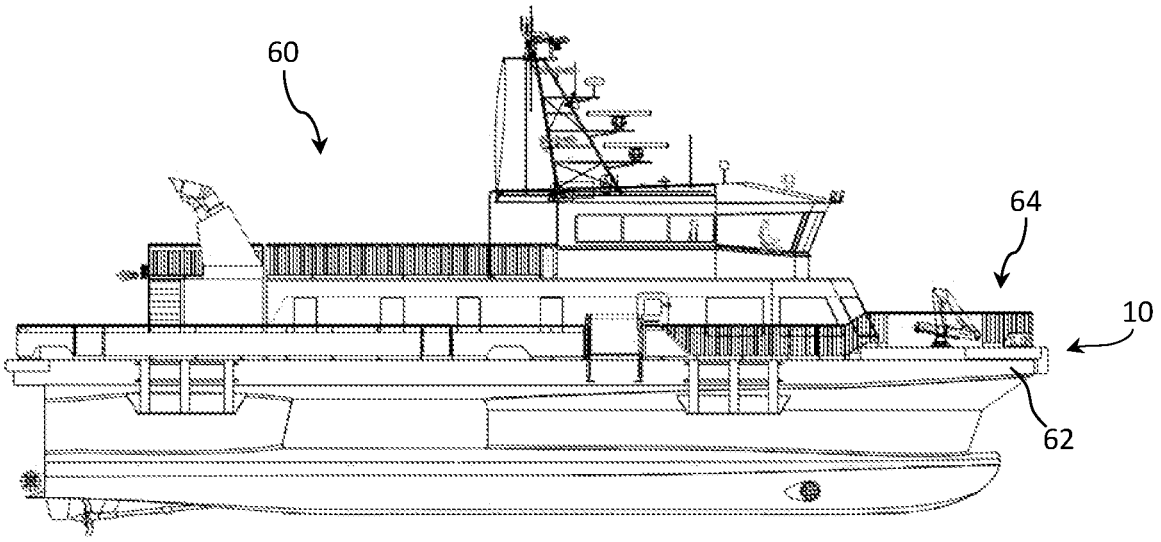
FIG. 1 shows an example of a crew transfer vessel equipped with a bow fender.

The present invention is related to a vessel 60 as shown in FIG. 1, such as a crew transfer vessel discussed previously, equipped with a bow fender 10. At least an upper part of the bow 62 is on a front face flat and is equipped with an elongated bow fender 10 placed transverse on the bow 62. The invention also relates to a stabilizing or engagement apparatus mounted on said vessel 60.

Figure 2:
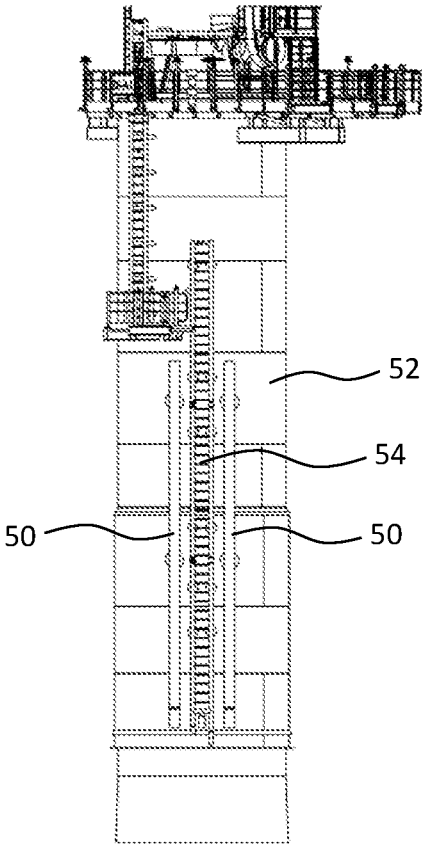
FIG. 2 shows an example of a stationary object, such as an offshore wind turbine foundation.

A wind turbine foundation 52 is shown in FIG. 2 having two vertical support poles/fender bars 50 to protect the wind turbine while the service vessel 60 approach the turbine and allows the service personnel to use a wind turbine ladder 54 between the two support poles for embarking and disembarking. With the vessel's engines/propellers, the vessel's transverse bow fender 10 is pushed against the support poles 50. A vessel 60 with a bow fender 10 according to the invention can be used to adjust or reduce the impact on the support poles, or other foundation, when the vessel 60 approaches and docs at the wind turbine.

Figure 5:
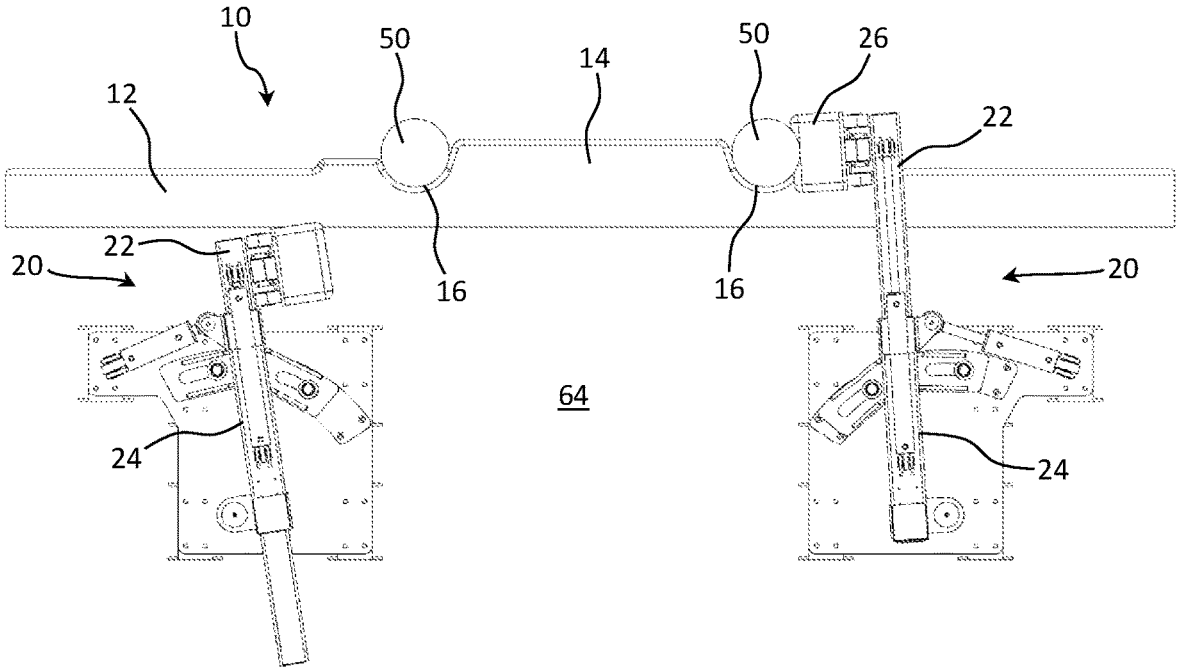
FIG. 5 shows a plan view of a bow fender and two engagement arms in parked and active positions, respective, in where the left engagement arm is in parked and retracted position and the right engagement arm is in active engagement position against a stationary object.

The bow fender 10 can in its simplest form be a rubber fender mounted to a base plate. One example of the bow fender 10, as shown in the drawings, can comprise an elongated rubber fender 12. In the middle of the rubber fender 12 there is a thicker part 14 protruding on a central front side, which is pressed against the support poles 50 and possibly the ladder 54 of the wind turbine foundation 52. The bow fender 10 further comprises, either in the thicker part 14 or adjacent the thicker part 14, an impression 16 for each pole 50 of the wind turbine foundation 52. As seen in FIG. 5, particularly on the left side, the rubber fender 12 can have several protruding steps with different thickness, which from left to center can be a first step with a first thickness, a second thicker step with the impression 16 and a third central and thickest step, in where the impression is located in the transition between the second and third step. The bow fender 10 is as mentioned mounted on the bow of a vessel 60, such as a crew transfer vessel, with the thicker part 14 facing forward.

The elongated fender 12 is disclosed as made of rubber, but the elongated fender 12 can be made of plastic or other suitable material such as polyurethane. The bow fender 10 is disclosed in relation to a wind turbine foundation but may of course be used with any similar offshore construction.

Such a bow fender 10 can for instance be approximately 10 m long, and with a thickness of 45 cm and a height of 65-100 cm. Support poles 50, or fender bars, on a typical wind turbine foundation 52 have a diameter of 33 cm, and a center distance of for instance 1.8 m. The thicker part 14 of the bow fender can be accommodated between the support poles 50 when the vessel 60 is pushing forward. The impressions 16 on the bow fender preferably have the same diameter as the support poles 50 of the wind turbine foundation 52.

Figure 3:
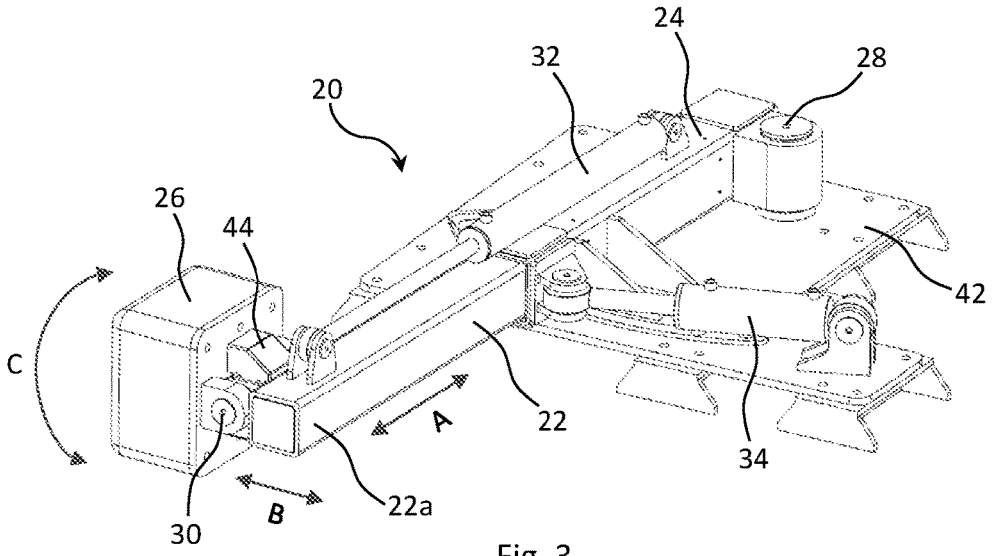
FIG. 3 shows a perspective view of an engagement arm with telescopic parts according to the invention.
Figure 4A:
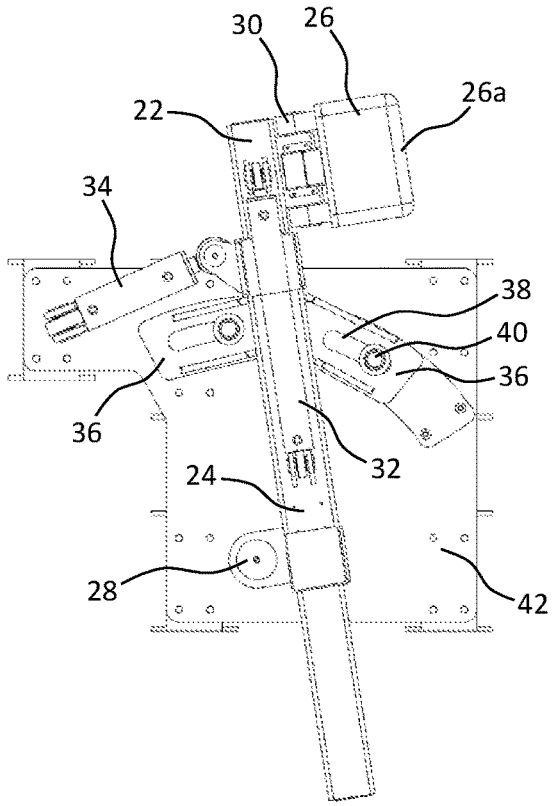
FIG. 4*a* shows a plan view of the engagement arm in a parked and retracted position.
Figure 4B:
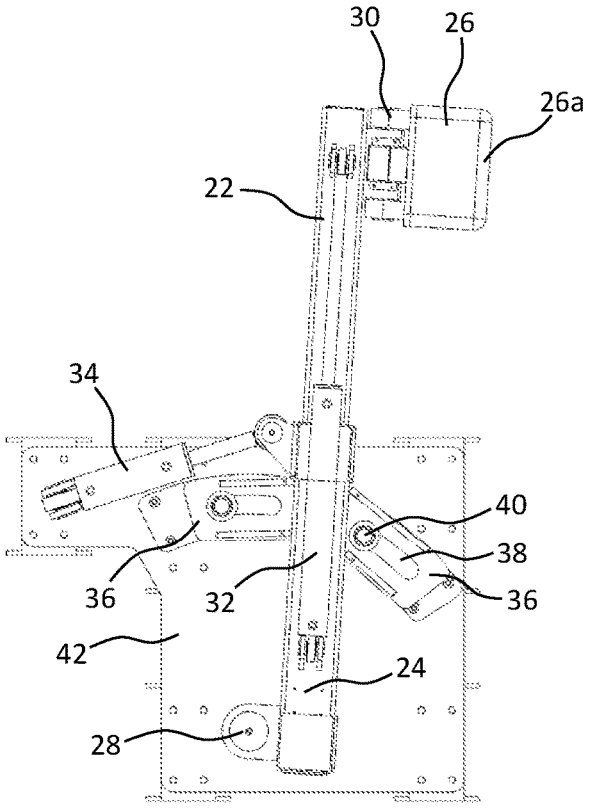
FIG. 4*b* shows a plan view of the engagement arm in an activated and extracted position.

FIG. 3 shows an engagement arm according to the invention, and which comprises at least two telescopic parts 22,24, wherein a first telescopic part 22 is movable from a retracted position to an extracted position slidably in a second housing part 24. The first telescopic part 22 is extracted and retraced by using a first pressure cylinder 32 connected between the first telescopic part 22 and the housing part 24, as indicated by the direction of the arrow A. The second housing part 24 is pivotably supported in a pivot connection 28, and the pivot movement is provided by a second pressure cylinder 34 connected to a distal end of the second housing part 24. Hence, the first telescopic part 22 and the second housing part 24 can thus swing or pivot in the direction indicated by the arrow B.

The pressure cylinders 32,34 can be hydraulic cylinders or pneumatic cylinders, or for that matter electric driven actuators, which can be connected to a control panel on a deck 64 of the vessel 60 or from a bridge of the vessel 60.

To guide the sideways pivot movement of the two telescopic parts 22,24, the second housing part 24 can be connected to one or more slide guides 36, for instance having a slot 38, straight or curved, in where a stationary pin 40 is moving. The second housing part 24 will thus be forced to move in the same directions as the slots 36.

An engagement pad 26 is tiltable mounted to an outer end of the first telescopic part 22, wherein the engagement pad 26 is tiltable supported in a hinged connection 30. The engagement pad 26 is tiltable about an axis running longitudinally and parallel to at least the first telescopic part 22 of the engagement arm 20, i.e. running in the same direction as the arrow A. Tilting movement is indicated by the arrow C.

The back of the engagement pad 26 can comprise one or more small rubber blocks 44 preventing the engagement pad 26 from "falling down" and tilt to much in a downward direction with respect to the first telescopic part 22. The small rubber blocks 44 can be screwed to a back plate of the hinged connection 30 and cover the hinged connection 30, and possibly abutting the outer end 22*a* of the first telescopic part 22 if the engagement pad 26 tilt too much. The pad of the engagement pad 26 can be made of rubber or polyurethane, and using small rubber blocks 44 on the backside may also counterbalance the engagement pad 26. Optionally, the tilting movement of the engagement pad 26 can be controlled by an actuator (not shown).

The rubber pad of the engagement pad 26 can be screwed to the back plate of the hinged connection 30, which makes it easy to exchange the pads in they get worn-out.

The tiltable engagement pad 26 has a contacting surface 26*a* creating stabilizing contact between the contacting surfaces 26*a* of the engagement pads 26 and at least a part of the stationary object 50, said engagement pads 26 being tiltable about an axis running in same longitudinal direction as the engagement arms 20.

In an embodiment (not shown) the engagement pad 26 can be tiltable in two directions, the first direction being about the first axis running in same longitudinal direction as the engagement arm 20 and the second direction being about a second axis running transverse to the first longitudinal axis.

The telescopic parts 22,24, pressure cylinders 32,34, slide guides 36, etc., can be mounted on a foundation 42, which is mounted on the deck 64 of the vessel 60. The foundation is mounted higher than the bow fender 10 to allow at least the first telescopic part 22 to be able to pivot above and at least partly in front of the bow fender 10.

During initial docking of the vessel 10 to the wind turbine foundation 52, the bow fender 10 will hit the support poles 50 of the wind turbine foundation 52. If the vessel is 150-175 dwt and the vessel is moving at 1-2 knots, the force will be quite large. As an example, the forces acting on one of the support poles on the wind turbine foundation 52 may vary from 440 kN for a vessel of 150 dwt and speed of 1 knots up to 2330 kN for a vessel of 175 dwt and speed of 2 knots. Dependent of the angle of the bow fender and the speed of the vessel, the combined impact forces on the support points may thus vary from approximately 40 kN to 260 kN. Hence, at least the support poles 50 of the wind turbine foundation 52 can be subjected to large forces.

FIG. 5 shows the bow fender 10 and two engagement arms 20 in parked and active positions, respective, in where the left engagement arm 20 is in parked and retracted position and the right engagement arm 20 is in active engagement position against a stationary object, such as the support poles 50 of the wind turbine foundation 52. The two engagement arms 20 can be activated simultaneously or separately.

Figure 6:
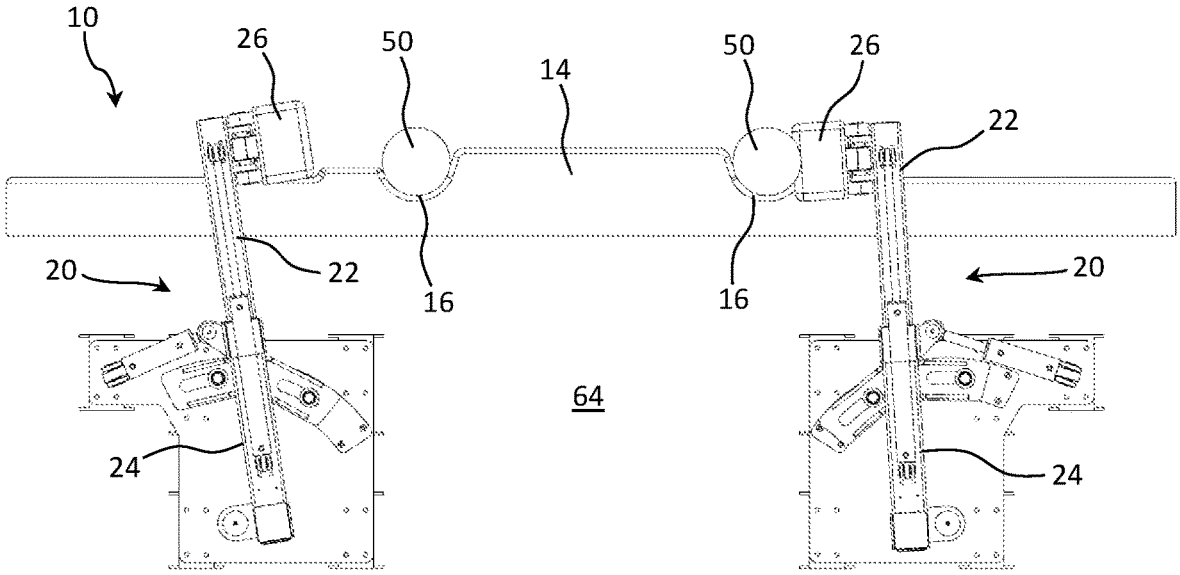
FIG. 6 shows a plan view of the bow fender and two engagement arms in active positions, in where the left engagement arm is being telescopically extracted and the right engagement arm is in active engagement position against the stationary object.
Figure 7:
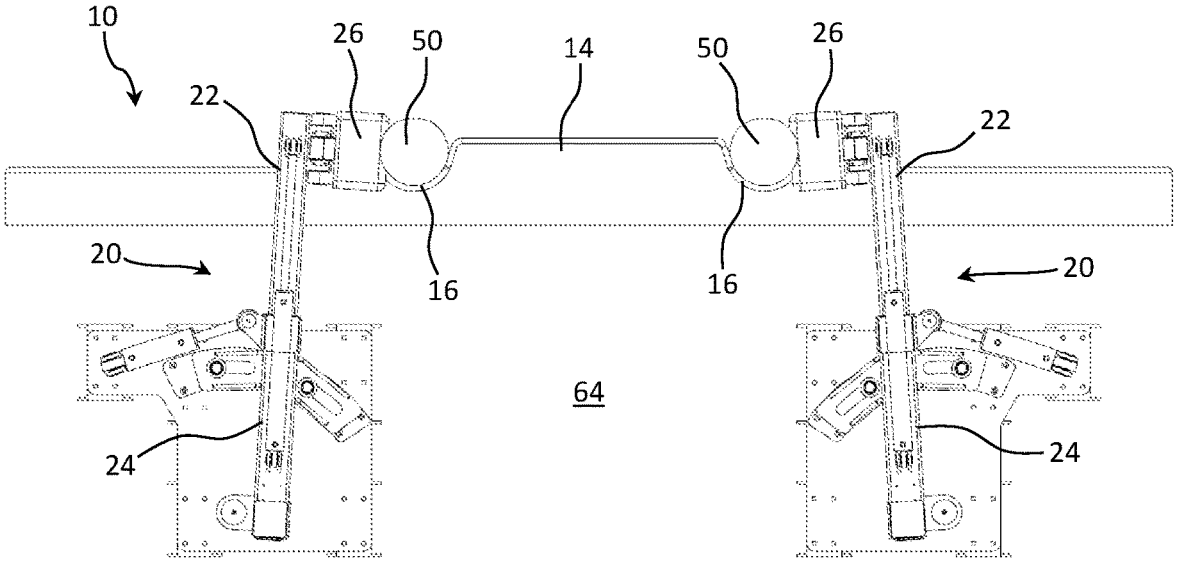
FIG. 7 shows a plan view of the bow fender and two engagement arms in active positions, in where the left engagement arm and the right engagement arm are in active engagement positions against the stationary object.
Figure 8:
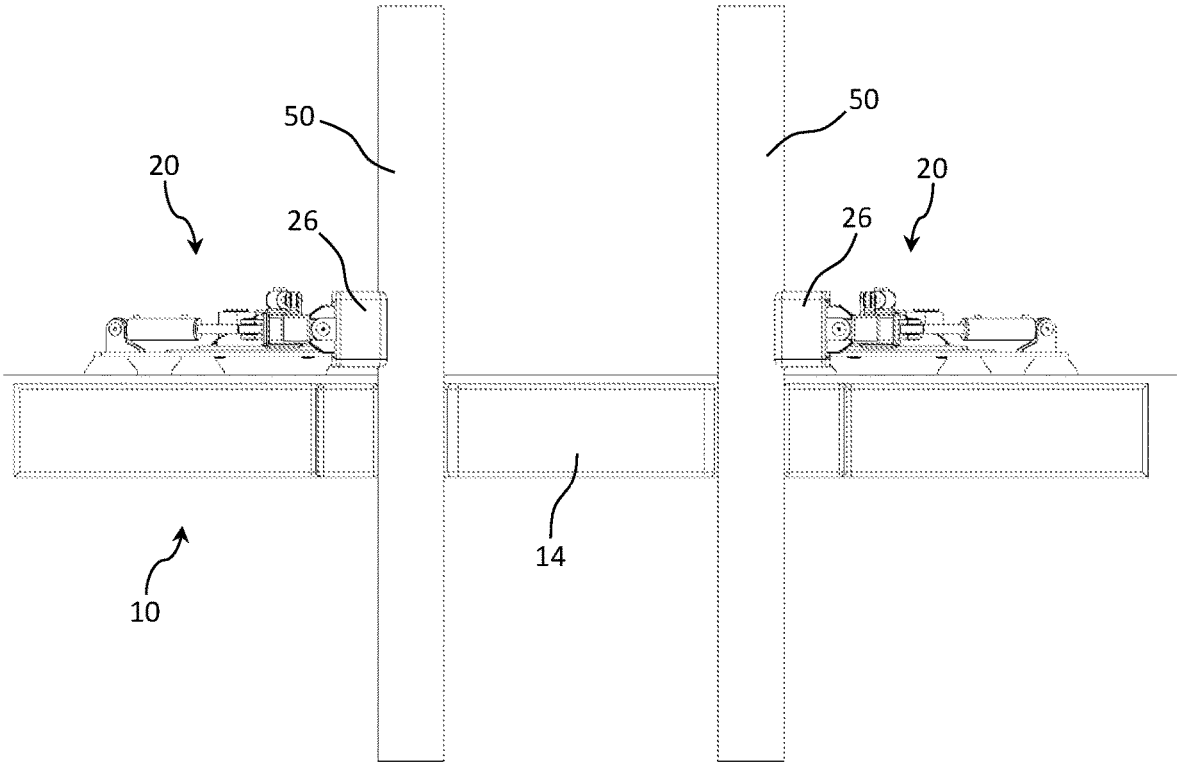
FIG. 8 shows a front view of the bow fender and two engagement arms in active positions, in where in the left engagement arm and the right engagement arm are in active engagement positions against the stationary object.

In FIG. 6 the left engagement arm 20 is being telescopically extracted and the engagement pad 26 is placed near the left pole 50, while the right engagement arm 20 is in active engagement position against the right pole 50. FIG. 7 shows the bow fender 10 and the two engagement arms 20 in active positions, in where the engagement pad 26 of the left engagement arm and the engagement pad 26 of the right engagement arm 20 are in active engagement positions against the two support poles 50 of the wind turbine foundation. FIG. 8 shows a front view of the bow fender 10 and the two engagement arms 20 in active positions.

When both engagement arms 20 are activated and pushed against the support poles 50 of the wind turbine foundation 52, as particularly seen in FIGS. 7 and 8, the support poles 50 will be accommodated and trapped in the impressions 16 on the bow fender 10, and the stabilizing contact between the contacting surfaces of the engagement pads 26 prevent any substantial movement of the support poles 50 with respect to the bow fender 10 in any direction. However, as the engagement arms are not locked at the backside of the support poles, the support poles will not be subjected to large tensile forces When the vessel is rolling transverse to the wind turbine foundation 52, the tiltable engagement pads 26 on the engagement arms 20 provides that even pressure is maintained in the contacting surfaces against the support poles 50, which improves safety.

It is possible with the present engagement arms 20 to adjust the pressure against the support poles 50, in both transverse and longitudinally direction.

I claim:

1. A vessel, comprising a transverse bow with an elongated bow fender protruding in a forward direction with respect to the bow, which bow fender is designed to be pushed against a stationary object, said vessel further comprises at least two engagement arms with several telescopic parts, said engagements arms are mounted in a position above the bow fender and facing each other, and each engagement arm is pivotable against each other for engagement with the stationary object from opposite directions, each engagement arm comprises a tiltable engagement pad with a contacting surface creating stabilizing contact between the contacting surfaces of the engagement pads and at least a part of the stationary object, said engagement pads being tiltable about an axis running in same longitudinal direction as the engagement arms, wherein the telescopic parts of each engagement arm comprise a first telescopic part and a second housing part, and the engagement pad is tiltable supported in a hinged connection on an outer free end of the first telescopic part, wherein the first telescopic part is extractable and slidably accommodated in the second housing part, and said second housing part is pivotably supported in a pivot connection, and wherein a first pressure cylinder is connected between the first telescopic part and the second housing part, providing extraction and retraction of the first telescopic part with respect to the second housing part.

2. The vessel according to claim 1, wherein a second pressure cylinder is connected to the second housing part in an area distal to said pivot connection, providing the pivot movement of the second housing part.

3. The vessel according to claim 2, wherein the second housing part comprises one or more slide guides guiding the pivot movement.

4. The vessel according to claim 1, wherein said hinged connection on the outer free end of the first telescopic part comprises one or more rubber blocks preventing unwanted tilting movement of the engagement pad with respect to the first telescopic part.

5. The vessel according to claim 1, wherein the bow fender comprises an elongated fender made of rubber.

6. The vessel according to claim 1, wherein the bow fender comprises an elongated fender made of polyurethane.

7. The vessel according to claim 1, wherein the bow fender on a front face comprises one or more impressions accommodating at least a part of the stationary object, and wherein the stabilizing contact between the contacting surfaces of the engagement pads when the engagement arms are activated prevent any substantial movement of said part of the stationary object with respect to the bow fender.

8. The vessel according to claim 1, wherein the contacting surface of the tiltable engagement pad is made of rubber.

9. The vessel according to claim 1, wherein the contacting surface of the tiltable engagement pad is made of polyurethane.

10. A stabilizing apparatus for a vessel, comprising at least two engagement arms with several telescopic parts, said engagements arms are facing each other, and each engagement arm is pivotable against each other for engagement with a stationary object from opposite directions, each engagement arm comprises a tiltable engagement pad with a contacting surface creating stabilizing contact between the contacting surfaces of the engagement pads and at least a part of the stationary object, said engagement pads being tiltable about an axis running in same longitudinal direction as the engagement arms, wherein the telescopic parts of each engagement arm comprise a first telescopic part and a second housing part, and the engagement pad is tiltable supported in a hinged connection on an outer free end of the first telescopic part, and wherein a first pressure cylinder is connected between the first telescopic part and the second housing part, providing extraction and retraction of the first telescopic part with respect to the second housing part.

11. The stabilizing apparatus according to claim 10, wherein the first telescopic part is extractable and slidably accommodated in the second housing part, and said second housing part is pivotably supported in a pivot connection.

12. The stabilizing apparatus according to claim 10, wherein a second pressure cylinder is connected to the second housing part in an area distal to said pivot connection, providing the pivot movement of the second housing part.

13. The stabilizing apparatus according to claim 12, wherein the second housing part comprises one or more slide guides guiding the pivot movement.

14. The stabilizing apparatus according to claim 10, wherein said hinged connection on the outer free end of the first telescopic part comprises one or more rubber blocks preventing unwanted tilting movement of the engagement pad with respect to the first telescopic part.

15. The stabilizing apparatus according to claim 10, wherein the contacting surface of the tiltable engagement pad is made of rubber.

16. The stabilizing apparatus according to claim 10, wherein the contacting surface of the tiltable engagement pad is made of polyurethane.

* * * * *